US012053668B2

(12) United States Patent
Cho

(10) Patent No.: US 12,053,668 B2
(45) Date of Patent: Aug. 6, 2024

(54) INDOOR EXERCISE BIKE

(71) Applicant: Chong Du Cho, Seoul (KR)

(72) Inventor: Chong Du Cho, Seoul (KR)

( * ) Notice: Subject to any disclaimer, the term of this patent is extended or adjusted under 35 U.S.C. 154(b) by 178 days.

(21) Appl. No.: 17/798,276

(22) PCT Filed: Aug. 19, 2020

(86) PCT No.: PCT/KR2020/011064
§ 371 (c)(1),
(2) Date: Aug. 8, 2022

(87) PCT Pub. No.: WO2021/162188
PCT Pub. Date: Aug. 19, 2021

(65) Prior Publication Data

US 2023/0096156 A1 Mar. 30, 2023

(30) Foreign Application Priority Data

Feb. 10, 2020 (KR) ..... 10-2020-0015629

(51) Int. Cl.

| | |
|---|---|
| ***A63B 22/06*** | (2006.01) |
| ***A63B 21/005*** | (2006.01) |
| ***A63B 23/04*** | (2006.01) |
| ***A63B 24/00*** | (2006.01) |

(52) U.S. Cl.
CPC ..... *A63B 22/0605* (2013.01); *A63B 21/005* (2013.01); *A63B 23/04* (2013.01); *A63B 24/00* (2013.01)

(58) Field of Classification Search
CPC ..... A63B 22/0605; A63B 22/0664; A63B 2022/0611; A63B 2022/0617; A63B 2022/0623; A63B 2022/0629; A63B 2022/0635; A63B 2022/0641;
(Continued)

(56) References Cited

U.S. PATENT DOCUMENTS

| | | | | |
|---|---|---|---|---|
| 9,492,700 | B1 * | 11/2016 | Wu | A63B 21/015 |
| 11,364,404 | B2 * | 6/2022 | Hsu | A63B 21/00069 |
| 11,794,054 | B2 * | 10/2023 | Petrillo | A63B 21/0051 |

(Continued)

FOREIGN PATENT DOCUMENTS

| | | | |
|---|---|---|---|
| CN | 103331011 | A | 10/2013 |
| KR | 1020070038636 | A | 4/2007 |

(Continued)

*Primary Examiner* — Zachary T Moore
(74) *Attorney, Agent, or Firm* — The Belles Group, P.C.

(57) ABSTRACT

The present invention relates to an indoor exercise bicycle capable of implementing an uphill mode and a downhill mode through a simple structure. An indoor exercise bicycle having uphill and downhill mode functions according to an embodiment of the present invention comprises: a brake unit that controls a pressing force applied to the circumferential surface of one side of a wheel, by means of forward movement of a brake mounting connected to a lead screw rotating through a motor; and a gear unit that is meshed with the brake unit of the lead screw while being spaced apart therefrom by a predetermined distance, and controls speed with respect to the rotational force of the wheel according to the rotation of the lead screw, wherein the brake unit may be operated in an uphill mode, and the gear unit may be operated in the downhill mode.

11 Claims, 7 Drawing Sheets

(58) Field of Classification Search
CPC .... A63B 2022/0647; A63B 2022/0652; A63B 2022/0658
See application file for complete search history.

(56) References Cited

U.S. PATENT DOCUMENTS

| | | | | |
|---|---|---|---|---|
| 2017/0056700 | A1* | 3/2017 | Wu | A63B 21/015 |
| 2019/0262651 | A1* | 8/2019 | Huang | A63B 21/015 |
| 2023/0093086 | A1* | 3/2023 | Petrillo | A63B 21/015 482/5 |

FOREIGN PATENT DOCUMENTS

| | | | |
|---|---|---|---|
| KR | 1020100020337 | A | 2/2010 |
| KR | 101036096 | B1 | 5/2011 |
| KR | 1020110116395 | A | 10/2011 |
| KR | 101246826 | B1 | 3/2013 |
| KR | 101776870 | B1 | 9/2017 |
| KR | 101827306 | B1 | 2/2018 |

* cited by examiner

[Fig. 1]
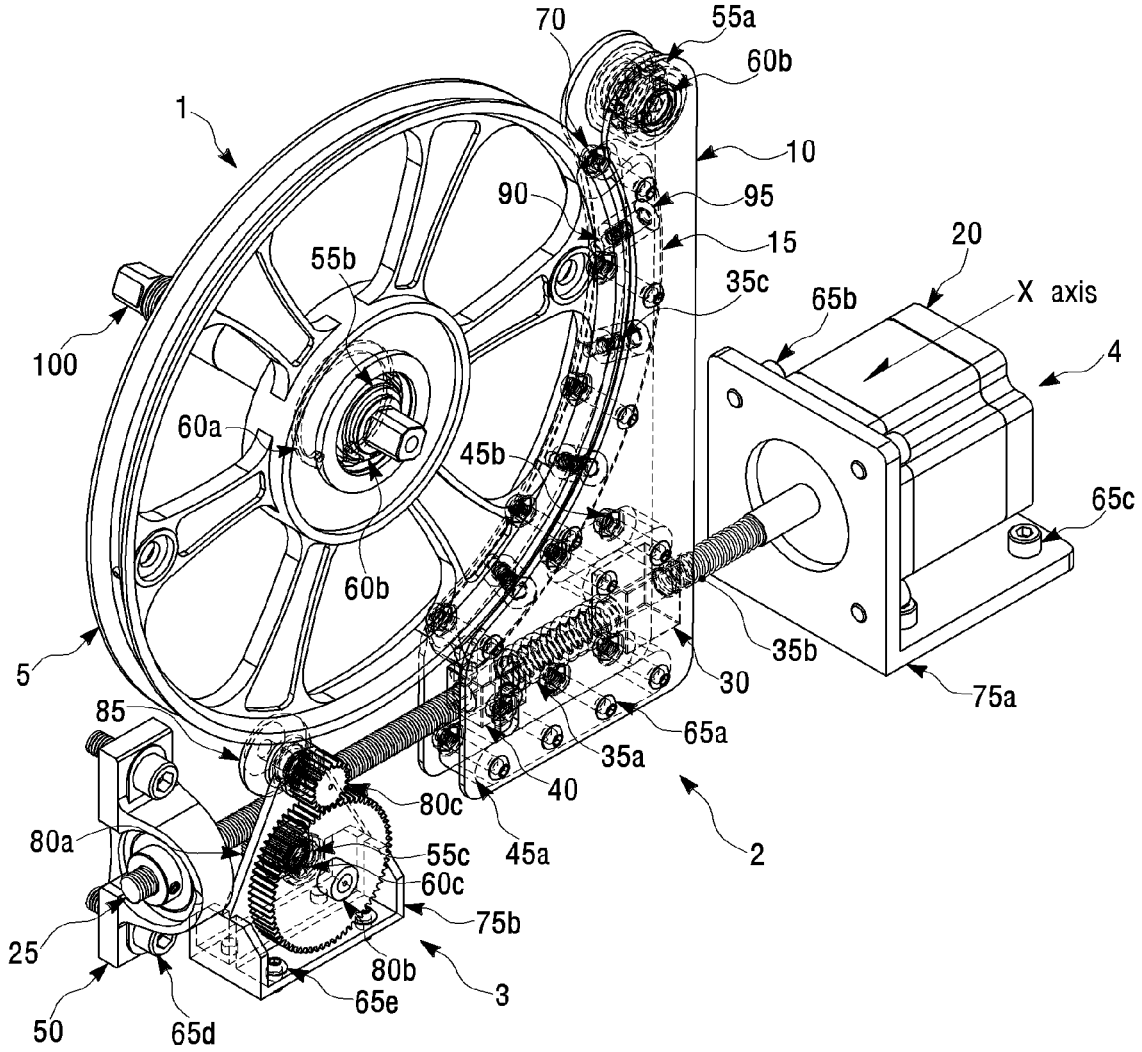

[Fig. 2]
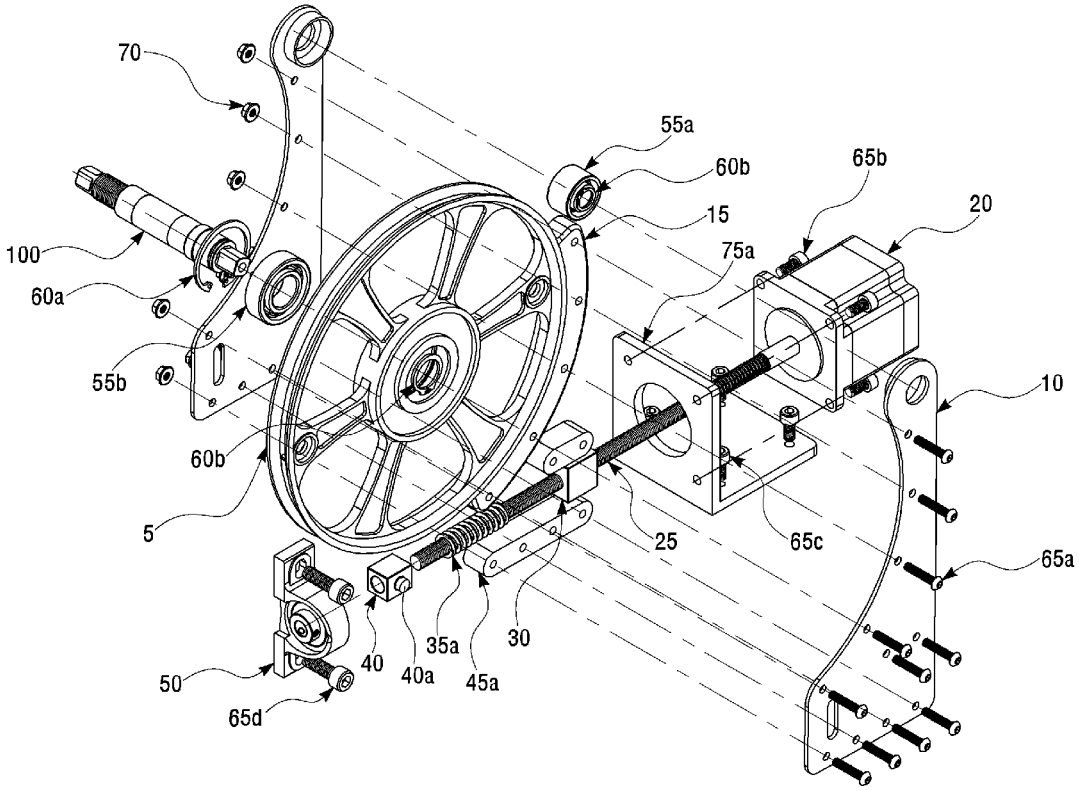

[Fig. 3]
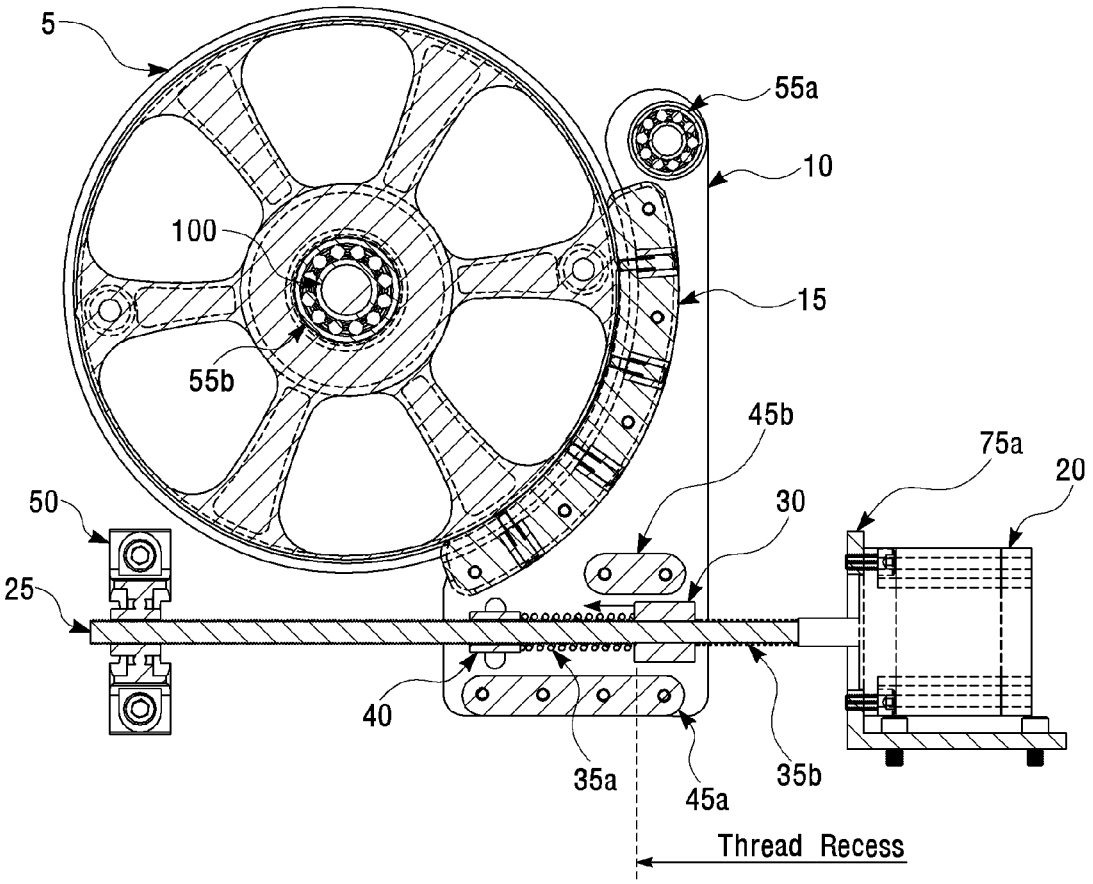

[Fig. 4]
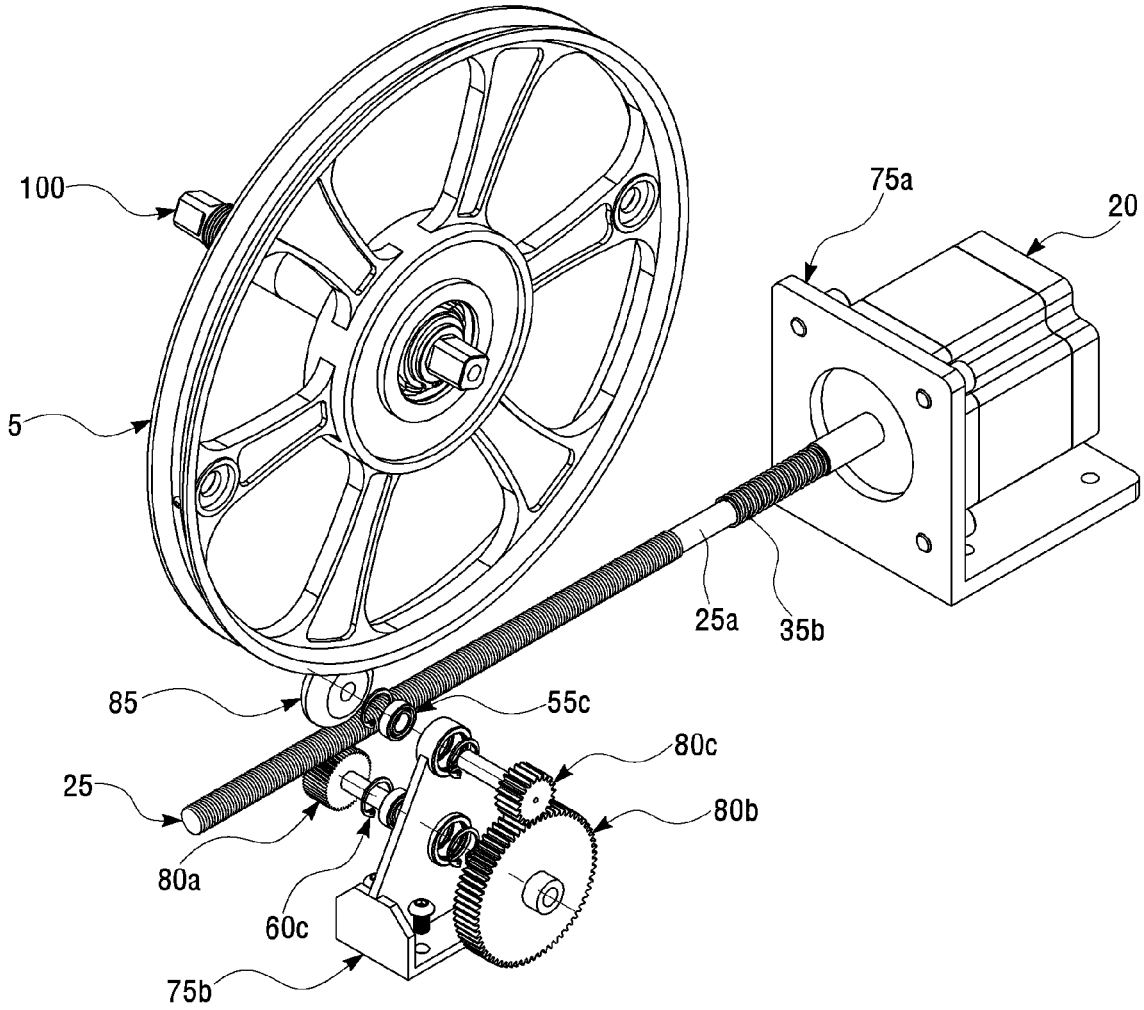

[Fig. 5]
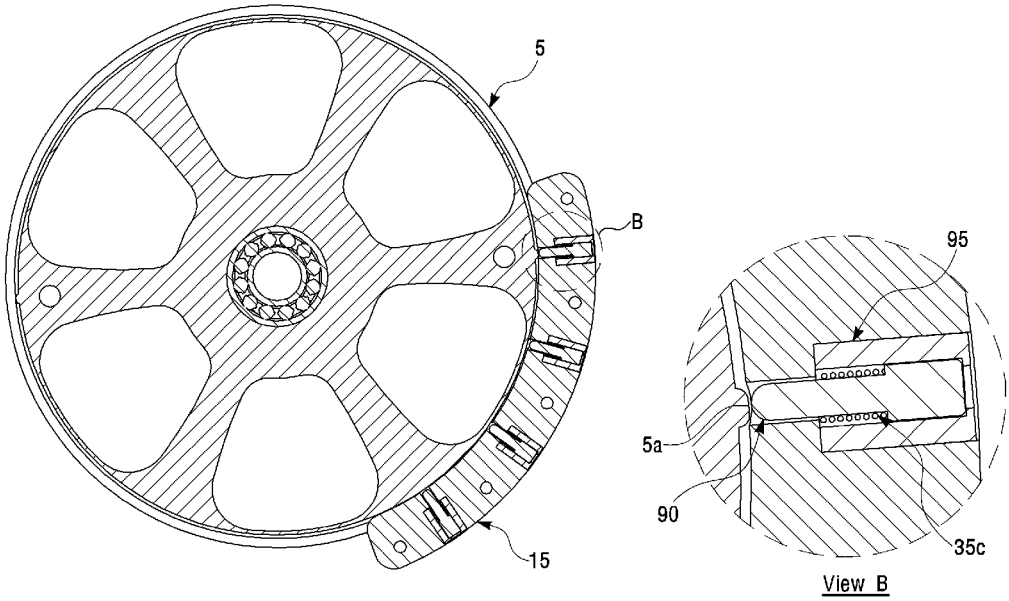

[Fig. 6]
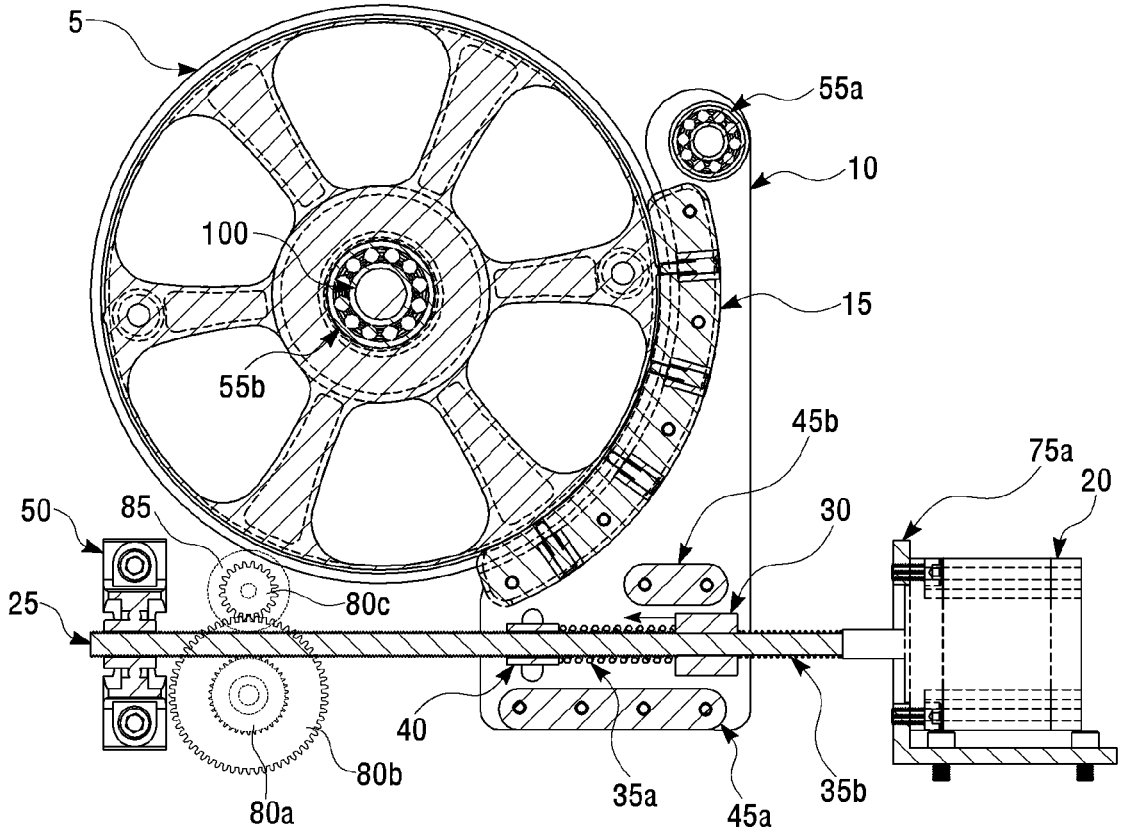

[Fig. 7]
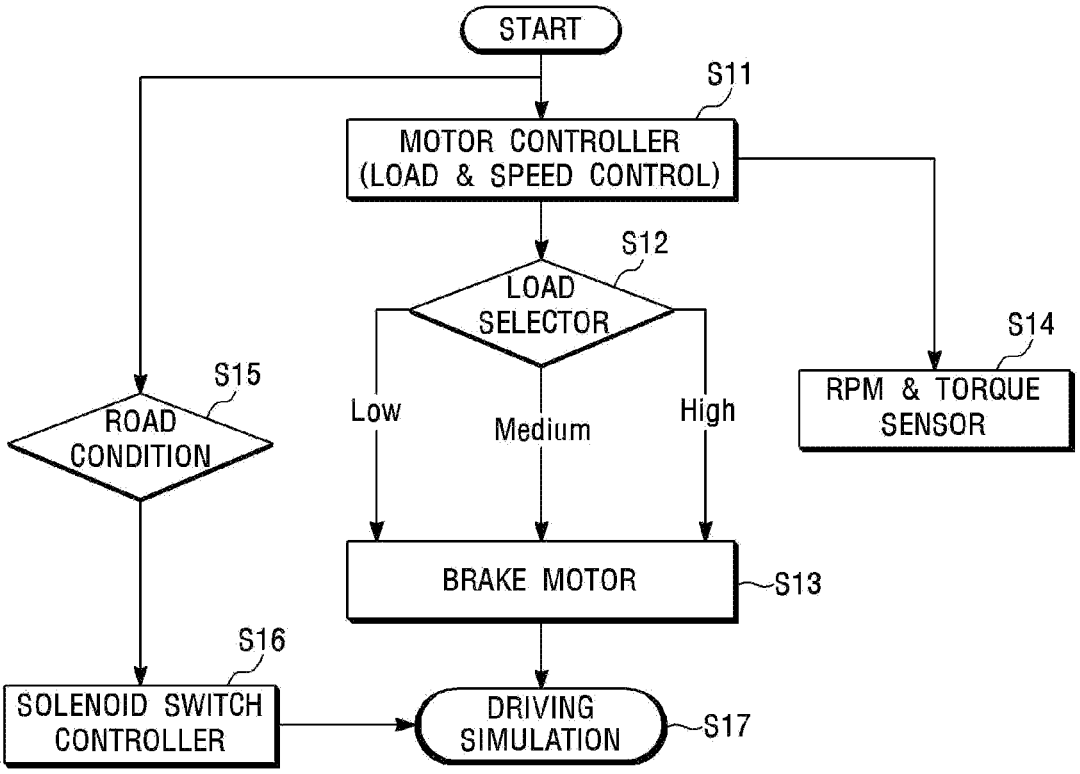

INDOOR EXERCISE BIKE

CROSS-REFERENCE TO RELATED PATENT APPLICATIONS

The present application is a U.S. national stage application under 35 U.S.C. § 371 of PCT Application No. PCT/KR2020/011064, filed Aug. 19, 2020, which claims priority to Korean Patent Application Nos. 10-2020-0015629, filed Feb. 10, 2020. The disclosures of the aforementioned priority applications are incorporated herein by reference in their entireties.

TECHNICAL FIELD

The present invention relates to an indoor exercise bicycle. More specifically, the present invention relates to an indoor exercise bicycle which can implement an uphill mode and a downhill mode including an electronic brake.

BACKGROUND TECHNOLOGY

An indoor exercise bicycle is an exercise device for obtaining an exercise effect similar to that of riding a bicycle indoors, and includes a wheel installed to freely rotate on a main body, and a pedal installed to support the user's foot to rotate the wheel by the user's leg movement.

Conventional indoor exercise bicycles are changing from static exercise forms where exercise through the rotation of wheels is conducted to dynamic exercise forms which increase the effect of actual exercise and add interest by varying the rotation forms of exercise bicycles according to external conditions, such as uphill, downhill, or bumpy ground.

In an uphill, such as an actual hill, the rotational force of a wheel is dampened and a force is exerted on a pedal stepping on the pedal. The manner of implementing this is very diverse.

Korean Patent Application Publication No. 10-2007-0038636 implements a coil member that generates an electromagnetic field on a wheel to be the same as when climbing an uphill road.

Korean Patent Application Publication No. 10-2010-0020337 forms a driving effect control means to achieve the same effect as running on a hill and a flat land by moving the front wheel drive means up and down. The driving effect control means implements this by connecting a driving pulley which is connected to a rotation shaft of a driving motor and a climbing pulley which is connected and driven by a belt.

Korean Patent Application Publication No. 10-2011-0116395 is implemented by installing an acceleration/deceleration motor coupled to a rotating shaft to control the exercise load of the user driving the rear wheel by adjusting the rotation speed of the rear wheel.

However, the above-mentioned conventional techniques have a certain limitation in implementing an effect of actually climbing a hill so that a force almost identical to an actual force is applied.

PRIOR ARTS (Patent Document 1) Korean Patent Application Publication No. 10-2007-0038636.

(Patent Document 2) Korean Patent Application Publication No. 10-2010-0020337.

(Patent Document 3) Korean Patent Application Publication No. 10-2011-0116395.

DETAILED DESCRIPTION OF THE INVENTION

Problem to be Solved

To solve the above problem, the present invention provides an indoor exercise bicycle to control rotational force of a wheel through a rotary motor, a shaft and a brake shoe in an uphill mode.

In addition, the present invention provides an indoor exercise bicycle which is controlled in a direction of increasing acceleration in a rotational force of a wheel through a rotating motor, a shaft, and a gear device in a downhill mode.

Another object of the present invention is to provide an indoor exercise bicycle capable of simplifying parts and simplifying structure by implementing the uphill mode and the downhill mode in real time or sequentially through one motor.

Other object of the present invention is to provide an indoor exercise bicycle to perform bending riding effect according to an uneven surface of an actual road surface by applying a bending effect to the rotation of a wheel by contacting a solenoid coil and a pin on a side surface of a wheel, in order to produce an effect of a curved uneven part of a road surface.

The problems to be solved by the present invention are not limited to the above problems. Other objects not mentioned will be clearly understood from the following description by those having ordinary skill in the technical field to which the present invention pertains.

Technical Solution

To solve the above-described problem, an indoor exercise bicycle having an uphill and downhill mode function according to an embodiment of the present invention may comprise: a brake unit for controlling a pressing force applied to a circumferential surface of a wheel by advance of a brake mounting connected to a lead screw rotating through a motor; and a gear unit which is spaced apart from the brake unit by a predetermined distance to be engaged with the lead screw and controls speed of a rotational force of the wheel according to a rotation of the lead screw. The brake unit is operated in an uphill mode, and the gear unit is operated in a downhill mode.

The brake unit may comprise: a brake mounting formed in an arc shape along one circumferential surface of the wheel, and formed to contact the one circumferential surface of the wheel; a support slide block which is screwed to be coupled to one position of the lead screw and coupled to the brake mounting plate; a screw plunger which is screwed to be coupled to other position of the lead screw, and linearly moves according to a rotation of the lead screw; and a first spring which is inserted around the lead screw between the support slide block and the screw plunger The brake mounting may comprise: a brake mounting plate formed in an arc shape along one circumferential surface of the wheel; and a brake shoe formed in an arc shape along one circumferential surface of the wheel to contact one circumferential surface of the wheel.

The brake mounting plate has a shape in which a pair is coupled in left and right sides, and the brake mounting plate has a structure which is integrally fastened by bolts with a clamping block being inside thereof.

Inside of the brake shoe is provided with at least one solenoid coil, a solenoid pin positioned inside the solenoid coil to move in a straight line, and an elastic body inserted around the solenoid pin and both ends thereof are supported.

A constant screw tap is formed on an outer circumference of the lead screw, and a tapless where a screw tap is not formed is formed at the predetermined position by a predetermined interval.

A second spring is inserted at the tapless, and an inner diameter of the second spring is larger than an outer diameter of the tapless and smaller than an outer diameter of the screw tap of the lead screw.

The gear unit comprises: a first gear tap-connected to an end of the lead screw; a second gear where a center of the first gear is connected to one end of a shaft and other end of the shaft is connected to the second gear; a third gear being formed to engage with teeth formed on an outer periphery of the second gear; a rubber wheel which is connected to a center of the third gear by a shaft where outer periphery of the rubber wheel contacts outer periphery of the wheel and serves to enhance acceleration of the wheel.

The rubber wheel 85 includes an one way bearing at a center.

Effects of the Invention

In accordance with the configuration of the present invention described above, the present invention can provide an indoor exercise bicycle which controls a rotational force of a wheel through a rotary motor, a shaft, and a brake shoe, in an uphill mode.

In addition, the present invention can provide an indoor exercise bicycle which is controlled in a direction of increasing acceleration in a rotational force of a wheel through a rotating motor, a shaft, and a gear device in a downhill mode.

In addition, the present invention can provide an indoor exercise bicycle capable of simplifying parts and simplifying structure by implementing the uphill mode and the downhill mode in real time or sequentially through one motor.

In addition, it is possible to perform bending riding effect according to an uneven surface of an actual road surface by applying a bending effect to the rotation of a wheel by contacting a solenoid coil and a pin on a side surface of a wheel, in order to produce an effect of a curved uneven part of a road surface.

Objects to be solved by the present invention are not limited to the above-described objects, and other objects that are not mentioned will be clearly understood by those skilled in the art from the following description.

Further scope of applicability of the present invention will become apparent from the following detailed description. It is to be understood that both the foregoing general description and the following detailed description are exemplary and explanatory and are intended to provide further explanation of the invention as claimed.

BRIEF DESCRIPTION OF THE DRAWINGS

FIG. 1 Is a coupling structural view of a brake and a wheel of an indoor exercise bicycle having an uphill and downhill mode function in accordance with the present invention.

FIG. 2 Is a break view showing the brake portion of FIG. 1 (except gear unit).

FIG. 3 Is a cross-sectional view in an X direction of FIG. 1 other than the gear unit.

FIG. 4 Is a break view showing the gear unit of FIG. 1.

FIG. 5 is a diagram showing a structure for reproducing a road surface depending on a road surface state by a solenoid pin in a state of being engaged with the wheel and the brake shoe in accordance with the present invention.

FIG. 6 Is a diagram for illustrating the operation state of the gear unit in the operating state in an uphill mode and the operation state of the brake unit in a downhill mode according to the present invention.

FIG. 7 Is a control block diagram of an uphill mode, a downhill mode, and a load condition mode of an indoor exercise bicycle having an uphill and downhill mode function in accordance with the present invention.

FORM FOR IMPLEMENTATION OF THE INVENTION

Detailed Description of the Preferred Embodiments

Hereinbelow, preferred embodiments of the present invention will be described in detail with reference to the drawings.

In the description of the embodiment, when described as being formed on "on (over)" or "under (below)" of each component, the on (over) or under (below) includes all that two components are in direct contact with each other or that one or more other components are disposed between the two components.

Also, in the case where the "on (over)" or "under (below)" is expressed, not only "upward" direction but also "downward" direction may be included based on one component.

In the drawings, the thicknesses of layers and regions may be exaggerated for clarity. The size of each component does not entirely reflect the actual size.

FIG. 1 Is a coupling structural view of a brake and a wheel of an indoor exercise bicycle having an uphill and downhill mode function in accordance with the present invention.

FIG. 1 shows a structure of a wheel and a brake included in an indoor exercise bicycle. It may be referred to as a wheel and brake coupling structure. The design or structure of an indoor exercise bicycle is omitted.

As shown in FIG. 1, the wheel and brake coupling structure of the present invention may include a driving unit 1, a brake unit 2, a gear unit 3, and a power unit 4.

The driving unit 1 may include a rotating wheel-shaped wheel 5 connected to a body as driving means of the indoor exercise bicycle, and a pedal shaft 100 for adding rotational force of the wheel 5.

The brake unit 2 may include a brake mounting plate 10, a brake shoe 15, a lead screw 25, a screw plunger 30, a spring 35, a support slide block 40, a clamping block 45 and an end support 50.

The brake shoe 15 may include a solenoid pin 90 and solenoid coils 95. The brake mounting plate 10 and the brake shoe 15 may be integrally formed, and may be referred to as a brake mounting including each components.

The respective components and coupling relationships of the brake unit 2 are described below with reference to FIG. 2.

The gear unit 3 may include a bearing 55, a snap ring 60, a screw 65, a nut 70, a clamping plate 75*b*, gears 80 and a rubber wheel 85.

The respective components and coupling relationships of the gear unit 3 are described below with reference to FIG. 4.

The power unit 4 may include a brake motor 20 for generating power and a clamping plate 75*a* capable of fixing the brake motor 20.

The brake unit 2 adds the braking force of the wheel of the indoor exercise bicycle 5 and adjusts the braking force so as to make further enforce the pedal in an uphill mode of climbing a hill through a control unit (not shown).

The solenoid pin 90 and the solenoid coil 95 may be used to recreate an effect such as actually driving a rugged road surface under the control of a control unit (hereinafter referred to as a "road surface linked effect").

The gear unit 3 may act as a component which accelerates the acceleration of the wheel 5 according to the downhill angle of the hill in a downhill mode when descending a road such as a downhill.

FIG. 2 Is a break view showing the brake portion of FIG. 1. FIG. 3 is a cross-sectional view in an X direction of FIG. 1 other than the gear unit.

Referring FIGS. 1 through 3, a structure and a coupling relation of a brake unit 2 attached to the indoor exercise bicycle of the present invention will be described.

The brake unit 2 may include a brake mounting plate 10, a brake shoe 15, a lead screw 25, a screw plunger 30, and first and second springs 35*a* and 35*b*, a support slide block 40, a clamping block 45 and an end support 50.

The brake shoe 5 formed in the form of an arc along one circumferential surface of the wheel 15 comes into contact with the wheel 15 by a strong or weak force according to a force of the brake motor 20, and thereby to exert a different braking force against the rotational force of the wheel 5.

On the other side of the arc of the brake shoe 15, the brake mounting plate 10 is coupled.

The brake mounting plate 10 may have a shape in which a pair is coupled in left and right sides (may be integrated as needed), and one side may be formed in a shape of an arc, and both sides of the brake shoe 15 may be coupled by bolts 65*a*.

The brake mounting plate 10 may have a structure which is integrally fastened by bolts 65*a* with a clamping block 45*a* and 45*b* being inside thereof.

The brake mounting plate 10 may be formed integrally with the brake shoe 15, and may be in a separate form which is fastened with a bolt, as in the embodiment.

Between the upper and lower of the clamping block 45*a* and 45*b*, a lead screw 25 is placed with a predetermined gap space from a pair of the brake mounting plate 10.

The brake motor 20 is connected to one end of the lead screw 25 to apply a rotational force of the lead screw 25. The other end of the lead screw 25 is connected to the bearing so as to be able to rotate by the end support 50, and fastened with the bolt 65*d* to be fixed.

Between the both ends of the lead screw 25, that is, inside the brake mounting plate 10, is provided with a screw plunger 30, a spring 35, and a support slide block 40.

The support slide block 40 is coupled to the brake mounting plate 10 by a projection 40*a* on both sides thereof so as to be connected to the brake mounting plate 10 to perform a linear motion.

The screw plunger 30 is spaced apart from the support slide block 40 by a predetermined distance (and disposed at the brake motor 20 side), and is connected to the lead screw 25 by a tap-connection to allow the left and right linear motion according to the rotation of the lead screw 25.

Between the screw plunger 30 and the support slide block 40, a first spring 35*a* is positioned. The first spring 35*a* is inserted around the lead screw 25.

The outer circumference of the lead screw 25 is formed with a constant screw tap, and at the predetermined position at the brake motor 20 side is formed with a tapless (25*a*, FIG. 5) where a screw tap is not formed by a predetermined interval.

A second spring 35*a* is inserted at the tapless 25*a*, and an inner diameter of the second spring 35*b* is larger than an outer diameter of the tapless 25*a* and may be smaller than an outer diameter of the screw tap of the lead screw 25.

In the brake mounting plate 10, the reference symbol 55*a* formed at the upper end is a friction-free hinge including a bearing, which is a fixed hinge that is rotate-free during a braking operation.

As the lead screw 25 rotates by the brake motor 20, the brake mounting plate 10 advances by the screw pitch. And the brake pad (not shown) contacts the wheel 5 while rotating about the hinge 55*a* to generate a frictional torque.

Therefore, the brake mounting plate 10 may perform in parallel a control operation for decelerating rotation of the wheel according to the brake operation and the degree of uphill of the hill in the uphill mode FIG. 4 Is a break view showing the gear unit of FIG. 1.

Referring to FIG. 1 and FIG. 4, the gear unit 3 implemented in the indoor exercise bicycle of the present invention may include a bearing 55, a snap ring 60, a screw 65, a nut 70, a clamping plate 75*b*, gears 80, and a rubber wheel 85.

The gear unit 3 is a device for implementing downhill riding on a downhill road.

The gear unit 3 includes a first gear 80*a* tap-connected to an end of the lead screw 25. The center of the first gear 80*a* is connected to one end of a shaft and the other end of the shaft is connected to a second gear 80*b*.

A clamping plate 75*b* may be disposed between the first gear 80*a* and the second gear 80*b*.

A third gear 80*c* is formed to engage with the teeth formed on the outer periphery of the second gear 80*b*. The center of the third gear 80*c* is connected to one end of a shaft, and the center of the rubber wheel 85 is connected to the other end of the shaft.

The outer periphery of the rubber wheel 85 contacts the outer periphery of the wheel 5 and serves to enhance the acceleration of the wheel 5. The rubber wheel 85 may include a one way bearing at the center.

FIG. 5 Is a diagram showing a structure for reproducing a road surface depending on a road surface state with a solenoid pin in a state of being engaged with the wheel and the brake shoe in accordance with the present invention.

As shown in FIG. 5, the brake unit 2 of the indoor workout bicycle of the present invention may induce the brake shoe 15 to be braked while being in contact with the wheel 5, and increase a force to be applied to the pedal through gradual braking on the uphill mode.

A solenoid pin 90 and a solenoid coil 95 may be mounted in the brake shoe 15, and the solenoid pin 90 may be placed in a state inserted into the spring 35*c*.

One end of the spring 35*c* is supported at the head portion of the solenoid pin 90. The other end of the spring 35*c* is disposed to be supported at the end of the insertion hole where the solenoid coil 95 is inserted.

The solenoid pin 90, the solenoid coil 95, and the spring 35*c* use the solenoid principle. When a current is applied to the solenoid coil 95, a magnetic circuit surrounding the coil is magnetized, and a magnetic field of the magnetic circuit generates a magnetic force in the solenoid pin 90 to linearly reciprocate the solenoid pin 90 toward the wheel 5.

The linearity of the solenoid pin 95 is intensified according to the intensity of a current applied to the solenoid coil 90, and a protrusion 5*a* is formed at one position of the wheel 90 so as to engage a tip of the solenoid pin 5.

When the wheel 5 rotates, the protrusion 5*a* comes into contact with the plurality of solenoid pins 90 so that the wheel 5 wobbles similarly to the phenomenon of riding on a road surface, resulting in the effect of actually riding on an uneven road surface.

A plurality of solenoid pins 90 and solenoid coils 95 may be formed at predetermined intervals in the brake shoe 15. The solenoid coils 95 may be controlled to be different from each other by controlling the intensity of the current applied to each of the solenoid coils, respectively, to control the advance force of the solenoid pin 90 differently.

FIG. 6 Is a diagram for illustrating the operation state of the gear unit in the operating state in an uphill mode and the operation state of the brake unit in a downhill mode according to the present invention.

[Uphill Mode]

Referring to FIG. 6, the indoor workout bicycle of the present invention implements the uphill mode by the operation of the brake unit 2.

As the brake motor 20 rotates forward and backward, the lead screw 25 is also linked to perform a forward and backward rotation.

As the lead screw 25 rotates in the forward rotation, the brake shaft plunger 30 is advanced forward (arrow direction) by a screw-tab coupling, and thus, since the support slide block 40 is engaged with the brake mounting plate 10, an elastic force is applied to the first spring 35*a*, and as the brake mounting plate 10 moves forward, the brake shoe 15 moves in the forward direction to press the circumferential surface of one side of the wheel 5.

The elastic pressing force of the first spring 35*a* is increased according to the rotational driving force of the brake motor 1. The force of pressing the brake shoe 15 toward the wheel 5 is increased in accordance with the magnitude of the elastic pressing force. The pressing force can be controlled in accordance with the hill angle of a simulating hill.

Contrarily, when the brake motor 30 is rotated backward, the elastic force of the first spring 35*a* becomes smaller, and the pressing force of the brake shoe 15 can be reduced.

At this time, the first gear 80*a* to the third gear 80*c* which are engaged with the lead screw 25 rotates, but the rubber wheel 3 including the one-way bearing is locked in the backward direction, thereby making it idle in the current state.

Therefore, the brake unit 20 operates according to the rotational force of the brake motor 2, and the gear unit 3 is not operated.

[Downhill Mode]

Referring FIG. 6, the indoor exercise bicycle of the present invention implements the downhill mode by the operation of the gear unit 3.

In the downhill mode, the brake shaft plunger 20 is reversed by backward rotation of the brake motor 30, and is positioned in the tapless 25*a* region of the lead screw 25 and is supported by the second spring 35*b* on the opposite side.

At this time, the brake mounting plate 10 and the brake shoe 15 are placed in a fixed position while being spaced from the wheel 5, and the braking does not occur.

Alternatively, in the gear unit 3, the first gear 80*a* to the third gear 80*c* rotates by axial joint and intermesh in accordance with the backward rotation of the lead screw 25, and the rubber wheel 85 axially connected to the third gear 80*c* rotates while rotating through the one-way bearing.

Since the outer periphery of the rubber wheel 85 is in contact with the outer circumference of the wheel 5, the rubber wheel 85 further increases the rotational speed of the wheel 5.

[Continuous Uphill and Downhill, Rod Condition Application]

Referring FIG. 6, the indoor workout bicycle of the present invention implements the uphill mode by the operation of the brake unit 2.

As the brake motor 20 rotates forward and backward, the lead screw 25 is also linked to perform a forward and backward rotation.

As the lead screw 25 rotates in the forward rotation, the brake shaft plunger 30 is advanced forward (arrow direction) by a screw-tab coupling, and thus, since the support slide block 40 is engaged with the brake mounting plate 10, an elastic force is applied to the first spring 35*a*, and as the brake mounting plate 10 moves forward, the brake shoe 15 moves in the forward direction to press the circumferential surface of one side of the wheel 5.

The elastic pressing force of the first spring 35*a* is increased according to the rotational driving force of the brake motor 1. The force of pressing the brake shoe 15 toward the wheel 5 is increased in accordance with the magnitude of the elastic pressing force. The pressing force can be controlled in accordance with the hill angle of a simulating hill.

On the other hand, the first gear 80*a* to the third gear 80*c* which are engaged with the lead screw 25 rotates, but the rubber wheel 3 including the one-way bearing is locked in the backward direction, thereby making it idle in the current state.

Therefore, only the brake unit 20 operates according to the rotational force of the brake motor 2, and the uphill mode may be implemented.

Then, in the downhill mode, the brake shaft plunger 20 is reversed by backward rotation of the brake motor 30, and is positioned in the tapless 25*a* region of the lead screw 25 and is supported by the second spring 35*b* on the opposite side.

At this time, the brake mounting plate 10 and the brake shoe 15 are placed in a fixed position while being spaced from the wheel 5, and the braking does not occur, so that no uphill operation is performed.

Alternatively, in the gear unit 3, the first gear 80*a* to the third gear 80*c* rotates by axial joint and intermesh in accordance with the backward rotation of the lead screw 25, and the rubber wheel 85 axially connected to the third gear 80*c* rotates while rotating through the one-way bearing.

Since the outer periphery of the rubber wheel 85 is in contact with the outer circumference of the wheel 5, the rubber wheel 85 further increases the rotational speed of the wheel 5 so that a downhill condition of the exercise condition may be implemented.

In the uphill and downhill mode (also in the flatland mode), road surface linked effect according to load conditions may be implemented together as it is.

When the wheel 5 rotates, the protrusion 5*a* comes into contact with the plurality of solenoid pins 90 so that the wheel 5 wobbles similarly to the phenomenon of riding on a road surface, resulting in the effect of actually riding on an uneven road surface.

A plurality of solenoid pins 90 and solenoid coils 95 may be formed at predetermined intervals in the brake shoe 15. The solenoid coils 95 may be controlled to be different from each other by controlling the intensity of the current applied to each of the solenoid coils, respectively, to control the advance force of the solenoid pin 90 differently. At the same time, it is possible to achieve a consistent road surface riding effect by simultaneously controlling the forward force equally by controlling the current of the same size.

FIG. 7 Is a control block diagram of an uphill mode, a downhill mode, and a load condition mode of an indoor exercise bicycle having an uphill and downhill mode function in accordance with the present invention.

n indoor exercise bicycle according to the present invention may be implemented with an uphill mode, downhill mode and the load condition mode, respectively.

Load and speed control are performed through the controller (S11).

The load corresponding to a hill road, a downhill road or a flatland is selected (S12).

A driving simulation is executed by controlling the brake motor according to the selected load (S17).

In S12, the rotation RPM and the torque of the brake motor are sensed by a sensor and transmitted to the controller to adjust the simulation state according to the road (S14).

On the one hand, the road condition can be operated separately or simultaneously with selecting the road (S15).

The road condition can be applied to the actual wheel by reproducing the uneven road surface, and the solenoid pin can be operated through the solenoid controller to effect road surface linked effects (S16).

The features, structures, effects, and the like described in the above embodiments are included in at least one embodiment of the present invention, and are not limited to only one embodiment. Furthermore. The features, structures, effects, and the like illustrated in each embodiment can be combined or modified to other embodiments by those skilled in the art; The contents related to the combination and deformation should be construed as being included in the scope of the present invention.

It will be apparent to those skilled in the art that various modifications and variations can be made in the present invention without departing from the spirit or scope of the inventions. For example, each component shown in detail in the embodiment can be modified and carried out. Such variations and modifications will be construed as being included within the scope of the present invention defined in the appended claims.

DESCRIPTION OF REFERENCE NUMBERS

1. Driving unit
2 Brake
3: Gear unit
4: Power unit
5 Wheel
10 Brake mounting plate
15: Brake shoe
20. Brake motor
25: Lead screw
30: Screw plunger
40: Support slide block
45: Clamping block
50: End support
85: Rubber wheel
90: Solenoid pin
95: Solenoid coil

The invention claimed is:

1. An indoor exercise bicycle having an uphill mode and a downhill mode, comprising:

a brake mounting comprising a brake mounting plate formed in an arc shape along one circumferential surface of a wheel to which a pedal shaft is connected, and formed to contact the one circumferential surface of the wheel;

a lead screw connected to a break motor to rotate;

a support slide block coupled onto the lead screw at a first position and coupled to the brake mounting plate;

a screw plunger threaded onto lead screw at a second position, configured to linearly move according to a rotation of the lead screw;

a first spring which is inserted around the lead screw between the support slide block and the screw plunger; and wherein a threadless section is formed on an outer circumference of the lead screw at a predetermined position for a predetermined interval.

2. The indoor exercise bicycle having the uphill mode and the downhill mode of claim 1, wherein the brake mounting comprises:

the brake mounting plate formed in the arc shape along the one circumferential surface of the wheel; and a brake shoe formed in an arc shape along the one circumferential surface of the wheel so as to be fastened to the arc of the brake mounting plate to contact the one circumferential surface of the wheel.

3. The indoor exercise bicycle having the uphill mode and the downhill mode of claim 2, wherein an inside of the brake shoe is provided with at least one solenoid coil, a solenoid pin positioned inside the solenoid coil to move in a straight line, and an elastic body inserted around the solenoid pin with both ends supported thereon.

4. The indoor exercise bicycle having the uphill and the downhill modes of claim 1, wherein the brake mounting plate comprises a pair of brake mounting plates on a left side and a right side of a clamping block which is integrally fastened by bolts to the pair of brake mounting plates.

5. The solenoid pin with both ends supported thereon of claim 1, wherein at a predetermined position of an outer periphery of the wheel, at least one protrusion is formed.

6. The solenoid pin with both ends supported thereon of claim 1, wherein a constant screw thread section is formed on the outer circumference of the lead screw.

7. The solenoid pin with both ends supported thereon of claim 6, wherein a second spring is inserted at the threadless section, and an inner diameter of the second spring is larger than an outer diameter of the threadless section and smaller than an outer diameter of the constant screw thread section of the lead screw.

8. The solenoid pin with both ends supported thereon of claim 1, wherein an inside of the brake mounting plate is provided with at least one solenoid coil, a solenoid pin positioned inside the solenoid coil to move in a straight line, and an elastic body inserted around the solenoid pin with both ends supported thereon.

9. The solenoid pin with both ends supported thereon of claim 1, further comprising:

a gear unit which is spaced apart from the brake unit by a predetermined distance to be engaged with the lead screw and controls a rotation force of the wheel according to a rotation speed of the lead screw;

wherein the brake unit is operated in the uphill mode, and the gear unit is operated in a the downhill mode.

10. The solenoid pin with both ends supported thereon of claim 9, wherein the gear unit comprises:

a first gear tap-connected to an end of the lead screw;

a second gear, wherein a center of the first gear is connected to one end of a first shaft and an other end of the shaft is connected to the second gear;

a third gear engaging with teeth formed on an outer periphery of the second gear; and a rubber wheel which is connected to a center of the third gear by a second shaft where outer periphery of the rubber wheel contacts outer periphery of the wheel and serves to enhance acceleration of the wheel.

11. The indoor exercise bicycle having uphill and downhill modes of claim 10, wherein the rubber wheel includes a one way bearing at center of the rubber wheel.

* * * * *